US007985066B2

(12) United States Patent
Chian et al.

(10) Patent No.: US 7,985,066 B2
(45) Date of Patent: Jul. 26, 2011

(54) COMBUSTION BLOWER CONTROL FOR MODULATING FURNACE

(75) Inventors: Brent Chian, Plymouth, MN (US); Timothy J. Nordberg, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 435 days.

(21) Appl. No.: 12/136,598

(22) Filed: Jun. 10, 2008

(65) Prior Publication Data

US 2009/0293867 A1 Dec. 3, 2009

Related U.S. Application Data

(63) Continuation of application No. 12/127,442, filed on May 27, 2008.

(51) Int. Cl.

| | |
|---|---|
| ***F23N 1/02*** | (2006.01) |
| ***F23N 1/00*** | (2006.01) |
| ***F23N 3/00*** | (2006.01) |
| ***F23N 3/02*** | (2006.01) |

(52) U.S. Cl. ..... 431/19; 431/12; 431/18; 431/20; 126/116 A

(58) Field of Classification Search ..... 431/20, 431/12, 19; 126/116 A

See application file for complete search history.

(56) References Cited

U.S. PATENT DOCUMENTS

| | | | |
|---|---|---|---|
| 4,251,025 | A | 2/1981 | Bonne et al. |
| 4,314,441 | A | 2/1982 | Yannone et al. |
| 4,329,138 | A | 5/1982 | Riordan |
| 4,334,855 | A | 6/1982 | Nelson |
| 4,340,355 | A | 7/1982 | Nelson et al. |
| 4,373,897 | A | 2/1983 | Torborg |
| 4,439,139 | A | 3/1984 | Nelson et al. |
| 4,502,625 | A | 3/1985 | Mueller |
| 4,533,315 | A | 8/1985 | Nelson |
| 4,684,060 | A | 8/1987 | Adams et al. |
| 4,688,547 | A | 8/1987 | Ballard et al. |
| 4,703,795 | A | 11/1987 | Beckey |
| 4,708,636 | A | 11/1987 | Johnson |
| 4,729,207 | A | 3/1988 | Dempsey et al. |
| 4,767,104 | A | 8/1988 | Plesinger |
| 4,819,587 | A | 4/1989 | Tsutsui et al. |
| 4,892,245 | A | 1/1990 | Dunaway et al. |
| 4,915,615 | A | 4/1990 | Kawamura et al. |
| 5,026,270 | A | 6/1991 | Adams et al. |
| 5,248,083 | A | 9/1993 | Adams et al. |
| 5,307,990 | A | 5/1994 | Adams et al. |
| 5,331,944 | A | 7/1994 | Kujawa et al. |

(Continued)

OTHER PUBLICATIONS

Honeywell, "45.801.175, Amplification Gas/Air Module for VK4105R/VK8105R Gas Controls," Production Handbook, 8 pages, prior to Oct. 18, 2006.

(Continued)

*Primary Examiner* — Kenneth B Rinehart
*Assistant Examiner* — William G Corboy, III
(74) *Attorney, Agent, or Firm* — Seager, Tufle & Wickhem LLC

(57) ABSTRACT

A furnace includes a combustion blower and one or more pressure switches. In some cases, the one or more pressure switches may be used to calculate one or more operating points for the combustion blower. Additional operating points may be calculated by interpolation and/or extrapolation, as appropriate. The furnace may temporarily alter these operating points as necessary to keep the furnace safely operating in response to minor and/or transient changes in the operating conditions of the furnace.

19 Claims, 11 Drawing Sheets

U.S. PATENT DOCUMENTS 5,340,028 A 8/1994 Thompson
5,347,981 A 9/1994 Southern et al.
5,408,986 A 4/1995 Bigham
5,520,533 A 5/1996 Vrolijk
5,557,182 A * 9/1996 Hollenbeck et al. ..... 318/432
5,590,642 A 1/1997 Borgeson et al.
5,630,408 A 5/1997 Versluis
5,682,826 A * 11/1997 Hollenbeck ..... 110/147
5,720,231 A 2/1998 Rowlette et al.
5,732,691 A 3/1998 Maiello et al.
5,791,332 A 8/1998 Thompson et al.
5,806,440 A 9/1998 Rowlette et al.
5,819,721 A 10/1998 Carr et al.
5,860,411 A 1/1999 Thompson et al.
5,865,611 A 2/1999 Maiello
5,993,195 A 11/1999 Thompson
6,000,622 A 12/1999 Tonner et al.
6,109,255 A 8/2000 Dieckmann et al.
6,254,008 B1 7/2001 Erickson et al.
6,257,870 B1 7/2001 Hugghins et al.
6,283,115 B1 9/2001 Dempsey et al.
6,321,744 B1 * 11/2001 Dempsey et al. ..... 126/116 A
6,354,327 B1 3/2002 Mayhew
6,377,426 B2 * 4/2002 Hugghins et al. ..... 361/23
6,571,817 B1 6/2003 Bohan, Jr.
6,666,209 B2 * 12/2003 Bennett et al. ..... 128/200.24
6,705,533 B2 3/2004 Casey et al.
6,749,423 B2 6/2004 Fredricks et al.
6,758,909 B2 7/2004 Jonnalagadda et al.
6,764,298 B2 7/2004 Kim et al.
6,793,015 B1 9/2004 Brown et al.
6,846,514 B2 1/2005 Jonnalagadda et al.
6,866,202 B2 3/2005 Sigafus et al.
6,880,548 B2 4/2005 Schultz et al.
6,918,756 B2 7/2005 Fredricks et al.
6,923,643 B2 8/2005 Schultz et al.
6,925,999 B2 8/2005 Hugghins et al.
7,055,759 B2 6/2006 Wacker et al.
7,101,172 B2 9/2006 Jaeschke
7,111,503 B2 9/2006 Brumboiu et al.
2002/0155404 A1 10/2002 Casey et al.
2002/0155405 A1 10/2002 Casey et al.
2003/0011342 A1 1/2003 Eichorn
2005/0159844 A1 7/2005 Sigafus et al.
2006/0105279 A1 5/2006 Munsterhuis et al.

OTHER PUBLICATIONS

Honeywell, "VK41..R/VK81..R Series, Gas Controls with Integrated Gas/Air Module for Combined Valve and Ignition System," Instruction Sheet, 6 pages, prior to Oct. 18, 2006.
http://www.regal-beloit.com/gedraft.html, "Welcome to GE Commercial Motors by Regal-Beloit," 1 page, printed Apr. 26, 2006.
Lennox, "G61MPV Series Units," Installation Instructions, 2 pages, Oct. 2006.

* cited by examiner

COMBUSTION BLOWER CONTROL FOR MODULATING FURNACE

This application is a continuation of U.S. patent application Ser. No. 12/127,442 filed May 27, 2008 entitled "COMBUSTION BLOWER CONTROL FOR MODULATING FURNACE", which application is incorporated by reference herein.

TECHNICAL FIELD

The disclosure relates generally to furnaces such as modulating furnaces having a combustion blower.

BACKGROUND

Many homes and other buildings rely upon furnaces to provide heat during cool and/or cold weather. Typically, a furnace employs a burner that burns a fuel such as natural gas, propane, oil or the like, and provides heated combustion gases to the interior of a heat exchanger. The combustion gases typically proceed through the heat exchanger, are collected by a collector box, and then are exhausted outside of the building via a vent or the like. In some cases, a combustion blower is provided to pull combustion air into the burner, pull the combustion gases through the heat exchanger into the collector box, and to push the combustion gases out the vent. At the same time, a circulating air blower typically forces return air from the building, and in some cases ventilation air from outside of the building, over or through the heat exchanger, thereby heating the air. The heated air is subsequently routed throughout the building via a duct system. A return duct system is typically employed to return air from the building to the furnace to be re-heated and then re-circulated.

In order to provide improved fuel efficiency and/or occupant comfort, some furnaces may be considered as having two or more stages, i.e., they can operate at two or more different burner firing rates, depending on how much heat is needed within the building. Some furnaces are known as modulating furnaces, because they can potentially operate at a number of different firing rates and/or across a range of firing rates. The firing rate of the furnace typically dictates the amount of gas and combustion air that is required by the burner. The amount of gas delivered to the burner is typically controlled by a variable gas valve, and the amount to combustion air is often controlled by a combustion blower. For efficient operation, the gas valve and the combustion blower speed need to operate in concert with one another, and in accordance with the desired firing rate of the furnace.

In some cases, the variable gas valve is a pneumatic amplified gas/air valve that is pneumatically controlled by pressure signals created by the operation of the combustion blower. As such, and in these cases, the combustion blower speed may be directly proportional to the firing rate. Therefore, an accurate combustion blower speed is required for an accurate firing rate. When the furnace is first installed, and/or during subsequent maintenance, a calibration process must often be performed by the installer to correlate the combustion blower speed with firing rate, which in some cases, can be a relatively time consuming and tedious process.

SUMMARY

The present disclosure relates generally to furnaces that exhibit improved control of combustion gas flow, and to methods of improving control of the combustion blower. In some instances, the disclosure relates to furnaces that include a combustion blower and one or more pressure switches with known pressure switch points. The one or more pressure switches may be used to derive one or more operating points for the combustion blower. Additional operating points of the combustion blower may be calculated by interpolation and/or extrapolation, as appropriate. It is contemplated that the furnace may temporarily alter certain operating points as necessary to keep the furnace safely operating in response to minor and/or transient changes in operating conditions.

An illustrative but non-limiting example may be found in a method of operating a combustion appliance that includes a variable speed combustion blower and a pressure switch. An expected combustion blower speed at which the pressure switch is expected to change state may be determined. The method may include detecting, during a combustion cycle, when the pressure switch does not change state at an expected combustion blower speed. In turn, the expected combustion blower speed may be temporarily adjusted to a temporary combustion blower speed that creates a pressure that permits the pressure switch to change state. The furnace may then continue to operate using the temporary combustion blower speed. At some point, the temporary combustion blower speed may revert back to the expected combustion blower speed, if desired.

Another illustrative but non-limiting example may be found in a method of calibrating a variable speed combustion blower that is disposed within an appliance that includes a first pressure switch and a second pressure switch. The combustion blower speed may be changed until the first pressure switch changes state. A first operating point of the combustion blower may be calculated based at least in part upon the combustion blower speed at which the first pressure switch changes state. Thereafter, the blower speed may again be changed until the second pressure switch changes state. A second operating point of the combustion blower may be calculated based at least in part upon the blower speed at which the second pressure switch changes state. A third (or further) operating point of the combustion blower may be calculated by, for example, interpolating between the first operating point and the second operating point, if desired.

Another illustrative but non-limiting example may be found in a controller that is configured to control a combustion appliance. The combustion appliance may include a burner, a gas valve that is configured to provide gas to the burner, a low pressure switch, a high pressure switch, and a combustion blower. In some cases, the low and high pressure switches may be configured to provide one or more control signal to the controller. The controller may be configured to calibrate the combustion blower speed for various operating points (e.g. firing rates) by altering the combustion blower speed to determine blower speeds at which the low pressure switch and the high pressure switch open and/or close.

In some cases, and during operation, the controller may be configured to determine, via the low pressure switch and/or the high pressure switch, when operating conditions have changed such that the low pressure switch and/or the high pressure switch do not change state at expected combustion blower speeds. In response, the controller may temporarily adjust the speed of the combustion blower so that the low pressure switch and/or the high pressure switch, as appropriate, change state. At some point, the temporary combustion blower speeds may revert back to the expected combustion blower speeds, if desired.

The above summary is not intended to describe each disclosed embodiment or every implementation. The Figures, Description and Examples which follow more particularly exemplify these embodiments.

BRIEF DESCRIPTION

The disclosure may be more completely understood in consideration of the following detailed description of various embodiments in connection with the accompanying drawings, in which.

Figure 1:
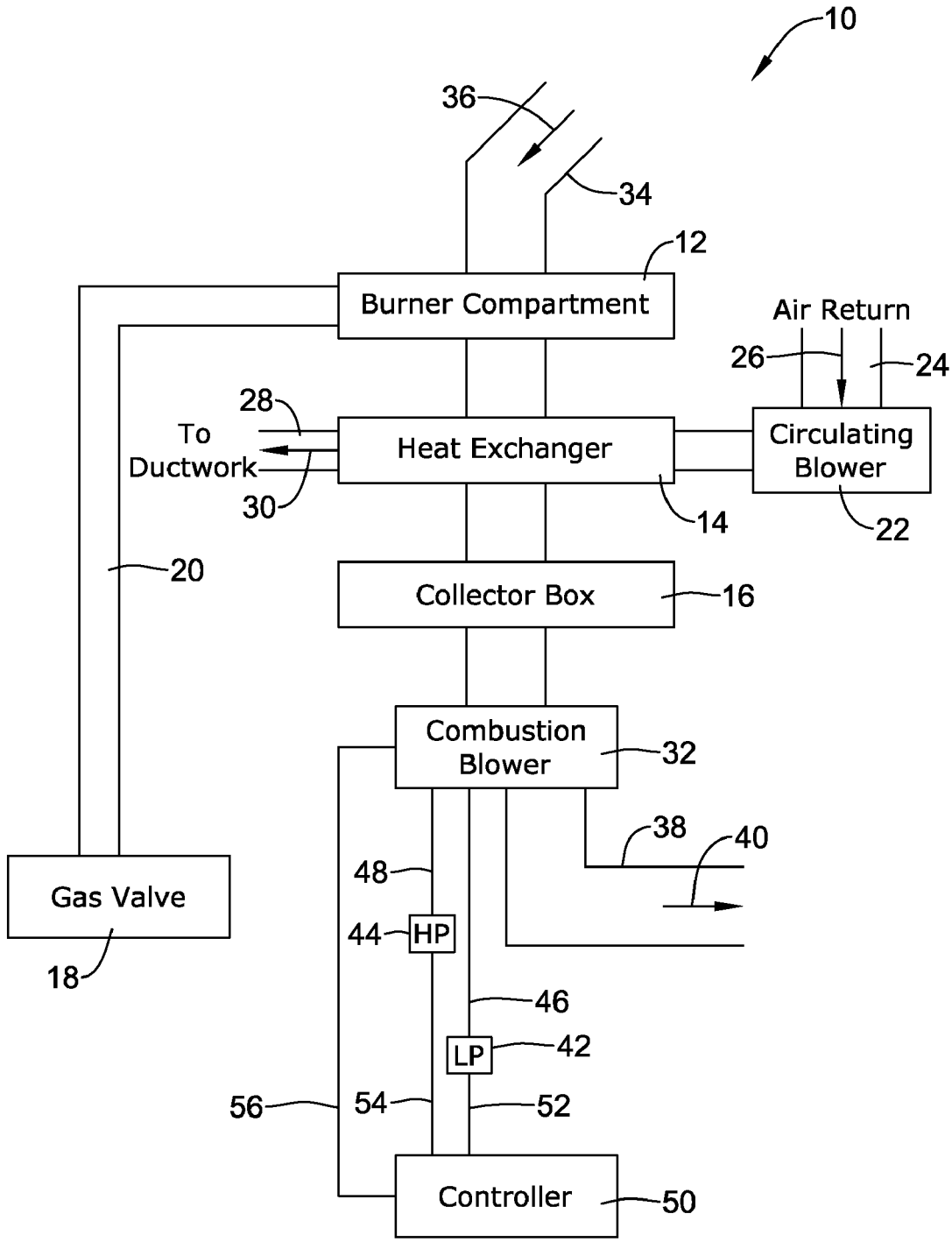
FIG. 1 is a schematic view of an illustrative but non-limiting furnace.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

FIG. 1 is a schematic view of a furnace 10, which may include additional components not described herein. The primary components of furnace 10 include a burner compartment 12, a heat exchanger 14 and a collector box 16. A gas valve 18 provides fuel such as natural gas or propane, from a source (not illustrated) to burner compartment 12 via a gas line 20. Burner compartment 12 burns the fuel provided by gas valve 18, and provides heated combustion products to heat exchanger 14. The heated combustion products pass through heat exchanger 14 and exit into collector box 16, and are ultimately exhausted to the exterior of the building or home in which furnace 10 is installed.

In the illustrative furnace, a circulating blower 22 accepts return air from the building or home's return ductwork 24 as indicated by arrow 26 and blows the return air through heat exchanger 14, thereby heating the air. The heated air exits heat exchanger 14 and enters the building or home's conditioned air ductwork 28, traveling in a direction indicated by arrow 30. For enhanced thermal transfer and efficiency, the heated combustion products may pass through heat exchanger 14 in a first direction while circulating blower 22 forces air through heat exchanger 14 in a second direction. In some instances, for example, the heated combustion products may pass generally downwardly through heat exchanger 14 while the air blown through by circulating blower 22 may pass upwardly through heat exchanger 14, but this is not required.

In some cases, as illustrated, a combustion blower 32 may be positioned downstream of collector box 16 and may pull combustion gases through heat exchanger 14 and collector box 16. Combustion blower 32 may be considered as pulling combustion air into burner compartment 12 through combustion air source 34 to provide an oxygen source for supporting combustion within burner compartment 12. The combustion air may move in a direction indicated by arrow 36. Combustion products may then pass through heat exchanger 14, into collector box 16, and ultimately may be exhausted through the flue 38 in a direction indicated by arrow 40.

In some instances, adequate combustion air flow into furnace 10 through combustion air source 34 and out of furnace 10 through flue 38 may be important to safe and effective operation of furnace 10. In some cases, the gas valve 18 may be a pneumatic amplified gas/air valve that is pneumatically controlled by pressure signals created by the operation of the combustion blower 32. As such, and in these cases, the combustion blower speed may be directly proportional to the firing rate of the furnace 10. Therefore, an accurate combustion blower speed may be required for an accurate firing rate.

In order to monitor air flow created by combustion blower 32, furnace 10 may include one or more of a low pressure switch 42 and a high pressure switch 44, each of which are schematically illustrated in FIG. 1. Low pressure switch 42 may be disposed, for example, in or near combustion blower 32 and/or may be in fluid communication with the flow of combustion gases via a pneumatic line or duct 46. Similarly, high pressure switch 44 may be disposed, for example, in or near combustion blower 32 and/or may be in fluid communication with the flow of combustion gases via a pneumatic line or duct 48.

As flow through an enclosed space (such as through collector box 16, combustion blower 32 and/or flue 38) increases in velocity, it will be appreciated that the pressure exerted on the high and lower pressure switches will correspondingly change. Thus, a pressure switch that has a first state at a lower pressure and a second state at a higher pressure may serve as an indication of flow. In some instances, a pressure switch may be open at low pressures but may close at a particular higher pressure.

Low pressure switch 42 may, in some cases, be open at low pressures but may close at a first predetermined pressure. This first pressure may, for example, correspond to a minimum air flow necessary for safe operation at a relatively low firing rate. High pressure switch 44 may, in some cases, be open at pressures higher than that necessary to close low pressure switch 42, but may close at a second predetermined pressure. This second pressure may, for example, correspond to a minimum air flow necessary for safe operations at a relatively higher firing rate.

As shown in FIG. 1, furnace 10 may include a controller 50 that may, in some instances, be an integrated furnace controller that is configured to communicate with one or more thermostat controllers or the like (not shown) for receiving heat request signals from various locations within the building or structure. It should be understood, however, that controller 50 may be configured to provide connectivity to a wide range of platforms and/or standards, as desired.

In some instances, controller 50 can be configured to control various components of furnace 10, including the ignition of fuel by an ignition element (not shown), the speed and operation times of combustion blower 32, and the speed and operation times of circulating fan or blower 22. In addition, controller 50 can be configured to monitor and/or control various other aspects of the system including any damper and/or diverter valves connected to the supply air ducts, any sensors used for detecting temperature and/or airflow, any sensors used for detecting filter capacity, and any shut-off valves used for shutting off the supply of gas to gas valve 18. In the control of other gas-fired appliances such as water heaters, for example, controller 50 can be tasked to perform other functions such as water level and/or temperature detection, as desired.

Controller 50 may, for example, receive electrical signals from low pressure switch 42 and/or high pressure switch 44 via electrical lines 52 and 54, respectively. In some instances, controller 50 may be configured to control the speed of combustion blower 32 via an electrical line 56. Controller 50 may, for example, be programmed to monitor low pressure switch 42 and/or high pressure switch 44, and adjust the speed of combustion blower 32 to help provide safe and efficient operation of the furnace. In some cases, controller 50 may also adjust the speed of combustion blower 32 in accordance with a desired firing rate based at least in part upon information received by controller 50 from a remote device such as a thermostat.

In some instances, it may be useful to determine a time constant for furnace 10. The time constant, i.e., how fast the furnace reacts to input changes, may be useful in operating components of furnace 10. For example, knowing the system time constant may inform the controller 50 (FIG. 1) on how long to wait for combustion blower 32 (FIG. 1) to reach equilibrium after altering the speed of combustion blower 32. Also, and in some cases, knowing the time constant may be useful in temporarily overdriving combustion blower 32 so that the combustion blower 32 can reach a desired combustion blower speed more quickly without significant overshoot or undershoot.

An illustrative but non-limiting example for determining the system time constant may begin with driving combustion blower motor 32 (FIG. 1) to a relatively high speed, such as 80 percent of its maximum. The motor RPM may be measured. Once the motor speed has stabilized, the motor may be driven to a lower speed. The RPM can be measured every N seconds until the motor speed stabilizes. The variable N can be less than the system time constant. If the motor speed stabilizes in less than N seconds, controller 50 may decrease the value of N and test again. From the various collected RPM values along with the time of each of the RPM values, the system time constant may be calculated. In some cases, the time constant may be calculated assuming a first-order system response.

In the above example, the system time constant has been determined when reducing the motor speed of combustion blower motor 32. In some cases, the system time constant may be determined when increasing the motor speed of the combustion blower motor 32. For example, the combustion blower motor 32 (FIG. 1) may be driven to a first speed. Once the motor speed has stabilized, the motor may be driven to a higher speed. The RPM can be measured every N seconds until the motor speed stabilizes. The variable N can be less than the system time constant. If the motor speed stabilizes in less than N seconds, controller 50 may decrease the value of N and test again. Like above, from the various collected RPM values along with the time of each of the RPM values, the system time constant may be calculated.

In some cases, multiple system time constants may be determined. For example, time constants may be determine for each of various operating RPM ranges (e.g. 0-500 RPM, 501-1000 RPM, 1000-2000 RPM, etc.) of the combustion blower motor 32. In another example, time constants may be determined for different RPM changes (e.g. change of 1-50 RPM, change of 51-100 RPM, change of 101-300 RPM, etc.) of the combustion blower motor 32. Different time constants can be determined for increases in RPM versus decreases in RPM. Each of these time constants can be stored in, for example, a lookup table or the like that can be accessed by controller 50. In some cases, the controller 50 may select the appropriate time constant from the lookup table, depending on the current operations of the furnace 10.

In some instances, determining a system time constant is at least somewhat dependent upon how close the actual combustion motor speed is to a commanded combustion motor speed. For example, if assuming a first order system, it will be appreciated that the actual motor speed may approach the commanded motor speed in an asymptotic manner. Thus, it will be recognized that the change in actual motor speed may be about 63.2 percent of the commanded change in motor speed once the time elapsed is equal to one time constant. After a period of time equal to two time constants, the actual change will be 86.5 percent of the commanded change. The actual change is 95 percent and 98 percent of the commanded change after a period of time equal to three time constants and four time constants, respectively. Thus, in determining the system time constant it may be useful to take this delay into account.

Figure 2:
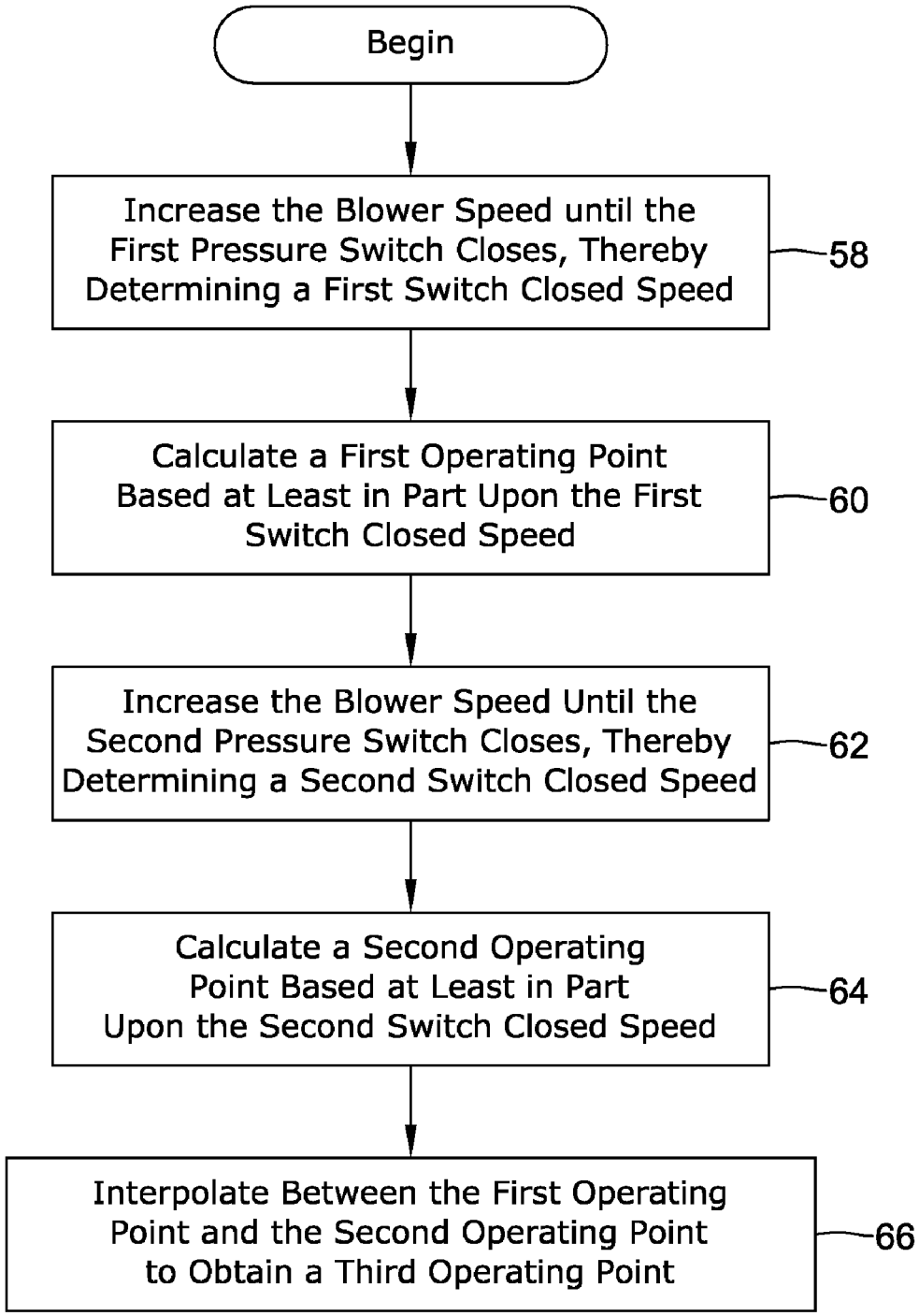
FIGS. 2 through 9 are flow diagrams showing illustrative but non-limiting methods that may be carried out by the furnace of FIG. 1.

FIGS. 2 through 9 are flow diagrams showing illustrative methods by which controller 50 may regulate aspects of operation of furnace 10. In FIG. 2, control begins at block 58, where the combustion blower speed is increased until the first pressure switch (such as low pressure switch 42) closes. In some instances, controller 50 may increase the blower speed and then wait for a period of time that is determined by using the system time constant before increasing the blower speed again, although this is not required.

It will be appreciated that although in the illustrated example the pressure switches are configured to be open at lower pressures and to close at a particular higher pressure, in some cases one or both of the pressure switches could instead be configured to be closed at lower pressures and to open at a particular higher pressure. Moreover, it will be appreciated that controller 50 could instead start at a high blower speed and then decrease the blower speed until the first and/or second pressure switches change state.

In some instances, controller 50 (FIG. 1) may determine a first switch closed speed based upon the combustion blower speed when the first pressure switch closes. Control passes to block 60, where a first operating point is calculated, based at least in part upon the first switch closed speed. In some instances, the first operating point may correspond to an RPM value for combustion blower 32 (FIG. 1) or an electrical signal representing an RPM value, although this is not required. In some cases, the first operating point may include a low pressure safety factor, which may, for example, be a value that is added to the RPM value to help ensure that the first pressure switch does indeed close at the first operating point.

At block 62, the blower speed may be increased until the second pressure switch (such as high pressure switch 44) closes. In some cases, a period of time at least as great as the system time constant may pass between successive blower speed increases, although this is not required. Controller 50 (FIG. 1) may determine a second switch closed speed based upon the combustion blower speed when the second pressure switch closes. Control passes to block 64, where a second operating point is calculated, based at least in part upon the second switch closed speed. In some instances, the second operating point may correspond to an RPM value (or an electrical signal representing an RPM value) for combustion blower 32 (FIG. 1), although this is not required. In some cases, the second operating point may include a high pressure safety factor, which may, for example, be a value that is added to the RPM value to help ensure that the second pressure switch does indeed close at the second operating point.

Control then passes to block 66, where controller 50 (FIG. 1) may calculate a third operating point based on the first operating point and the second operating point. In some instances, as illustrated, controller 50 may interpolate between the first operating point and the second operating point to obtain the third operating point. In some cases, the third operating point may represent an RPM value (or an electrical signal representing an RPM value) for combustion blower 32 (FIG. 1). In some instances, controller 50 may further calculate a fourth operating point, a fifth operating point, and so on. The number of operating points may, for example, be selected in accordance with a number of different burner firing rates that may be desired for furnace 10.

It will be appreciated that in some instances, one or both of the first operating point and the second operating point may represent midpoints, i.e., combustion blower 32 (FIG. 1) may have operating points below the first operating point and/or above the second operating point. In some instances, controller 50 (FIG. 1) may extrapolate from the first and/or second operating points in order to calculate a third operating point.

A variety of different interpolation and/or extrapolation techniques are contemplated. In some cases, controller 50 (FIG. 1) may perform a simple linear interpolation between the first operating point and the second operating point. In some instances, controller 50 may perform an interpolation that results in a non-linear relationship between firing rate and combustion blower speed. Depending, for example, on the operating dynamics of furnace 10 and/or the specifics of gas valve 18 and/or combustion blower 32, controller 50 may perform an interpolation that has any suitable relationship between, for example, firing rate and combustion blower speed. It is contemplated that the relationship may be a logarithmic relationship, a polynomial relationship, a power relationship, an exponential relationship, a piecewise linear relationship, a moving average relationship, or any other suitable relationship as desired.

Figure 3:
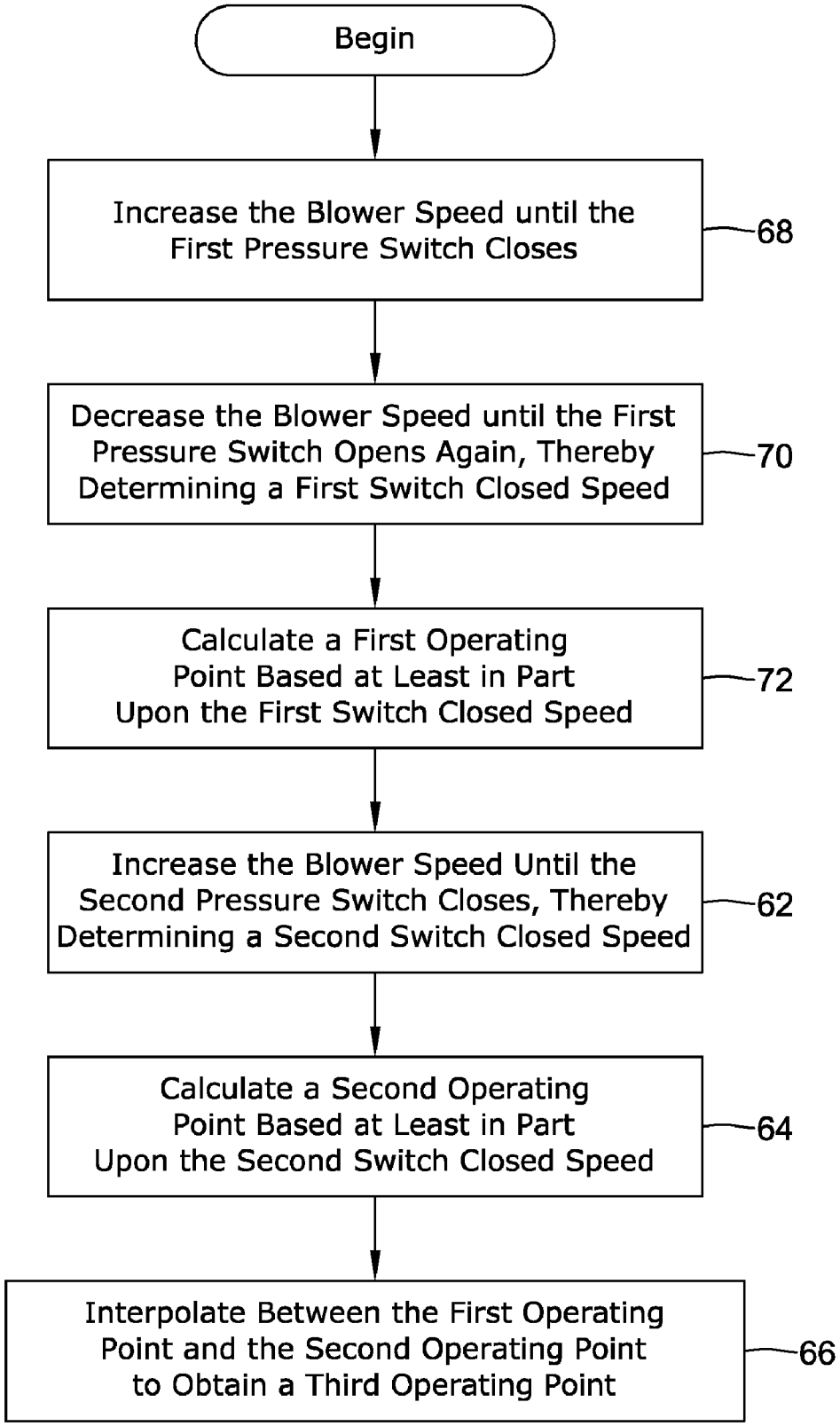

Turning now to FIG. 3, control begins at block 68, where the combustion blower speed is increased until the first pressure switch (such as low pressure switch 42) closes. Controller 50 (FIG. 1) may then decrease the blower speed until the first pressure switch reopens, to better determine the blower speed at which the first pressure switch opens and closes, as indicated at block 70, thereby determining a first pressure switch closed speed. At block 72, a first operating point is calculated, based at least in part upon the determined first switch closed speed. In some instances, the first operating point may correspond to an RPM value (or an electrical signal representing an RPM value) for combustion blower 32 (FIG. 1).

At block 62, the combustion blower speed is then increased until the second pressure switch (such as high pressure switch 44) closes. Controller 50 (FIG. 1) may determine a second switch closed speed based upon the blower speed when the second pressure switch closes. Control passes to block 64, where a second operating point is calculated, based at least in part upon the second switch closed speed. In some instances, the second operating point may correspond to an RPM value (or an electrical signal representing an RPM value) for combustion blower 32 (FIG. 1), although this is not required. In some cases, the second operating point may also be based upon a high pressure safety factor, which may, for example, be a value that is added to the RPM value to help ensure that the second pressure switch does indeed close at that RPM.

Control passes to block 66, where controller 50 (FIG. 1) may interpolate between the first operating point and the second operating point to obtain a third operating point as discussed above with respect to FIG. 2. In some instances, the first operating point and/or the second operating point may, for example, be based at least in part upon a low pressure safety factor and/or a high pressure safety factor, but this is not required. In some cases, a third operating point may also incorporate a safety factor, while in other cases a safety factor may be built in via the interpolation process (e.g. the endpoints include safety factors).

Figure 4:
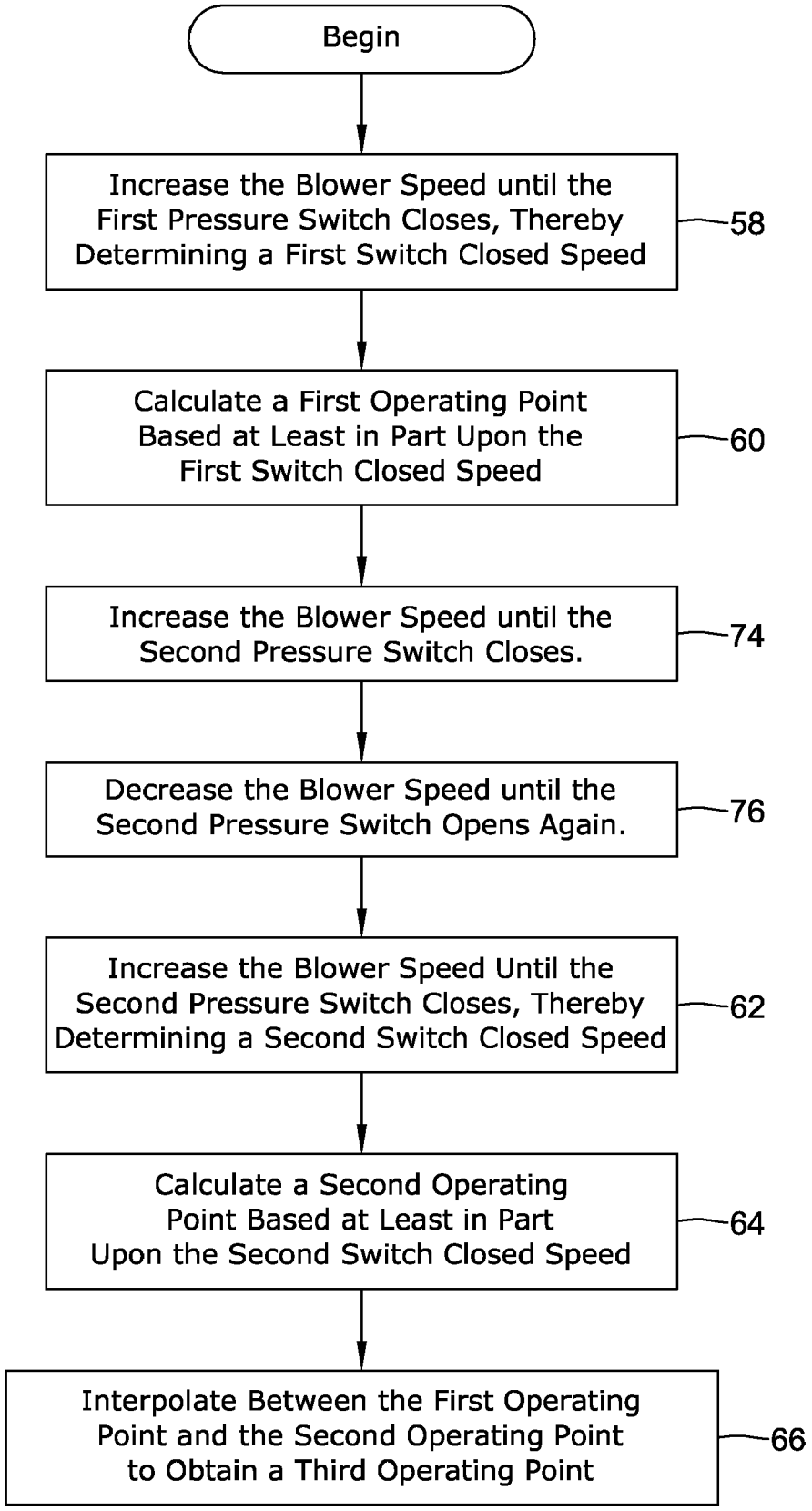

Turning now to FIG. 4, control begins at block 58, where the combustion blower speed is increased until the first pressure switch (such as low pressure switch 42) closes. Controller 50 (FIG. 1) may determine a first switch closed speed based upon the blower speed when the first pressure switch closes. Control passes to block 60, where a first operating point is calculated, based at least in part upon the first switch closed speed. In some instances, the first operating point may correspond to an RPM value (or an electrical signal representing an RPM value) for combustion blower 32 (FIG. 1).

Control then passes to block 74, where controller 50 increases the blower speed until the second pressure switch (such as high pressure switch 44) closes. At block 76, controller 50 decreases the blower speed until the second pressure switch reopens. Control passes to block 62, where controller 50 increases the blower speed until the second pressure switch closes again. A second switch closed speed may be determined, based upon the blower speed when the second pressure switch closes.

In some cases, the blower speed may be increased and decreased in equal steps. In some instances, the blower speed may be increased using medium steps of about 250 RPM or even large steps of about 1200 RPM each time, then small steps of about 50 RPM may be used in increasing and/or decreasing the blower speed to more precisely and more efficiently locate the point at which the pressure switch opens or closes. It will be appreciated that pressure switches may exhibit some level of hysteresis, and may not open or close at the same point, depending on whether the detected pressure is increasing or decreasing. Also, it is contemplated that the controller 50 may increase or decrease the blower speed, and then wait for a period of time that is determined using the system time constant, before increasing or decreasing the blower speed again, although this is not required.

Control passes to block 64, where a second operating point is calculated, based at least in part upon the second switch closed speed. In some instances, the second operating point may correspond to an RPM value (or an electrical signal representing an RPM value) for combustion blower 32 (FIG. 1), although this is not required.

Control is then passes to block 66, where controller 50 (FIG. 1) may interpolate between the first operating point and the second operating point to obtain a third operating point as discussed above with respect to FIG. 2. In some cases, the first operating point and/or the second operating point may, for example, be based at least in part upon a low pressure safety factor and/or a high pressure safety factor, but this is not required. In some cases, a third operating point may also incorporate a safety factor, while in other cases the safety factor may be built into the interpolation process (e.g. the endpoints include safety factors), if desired.

Figure 5:
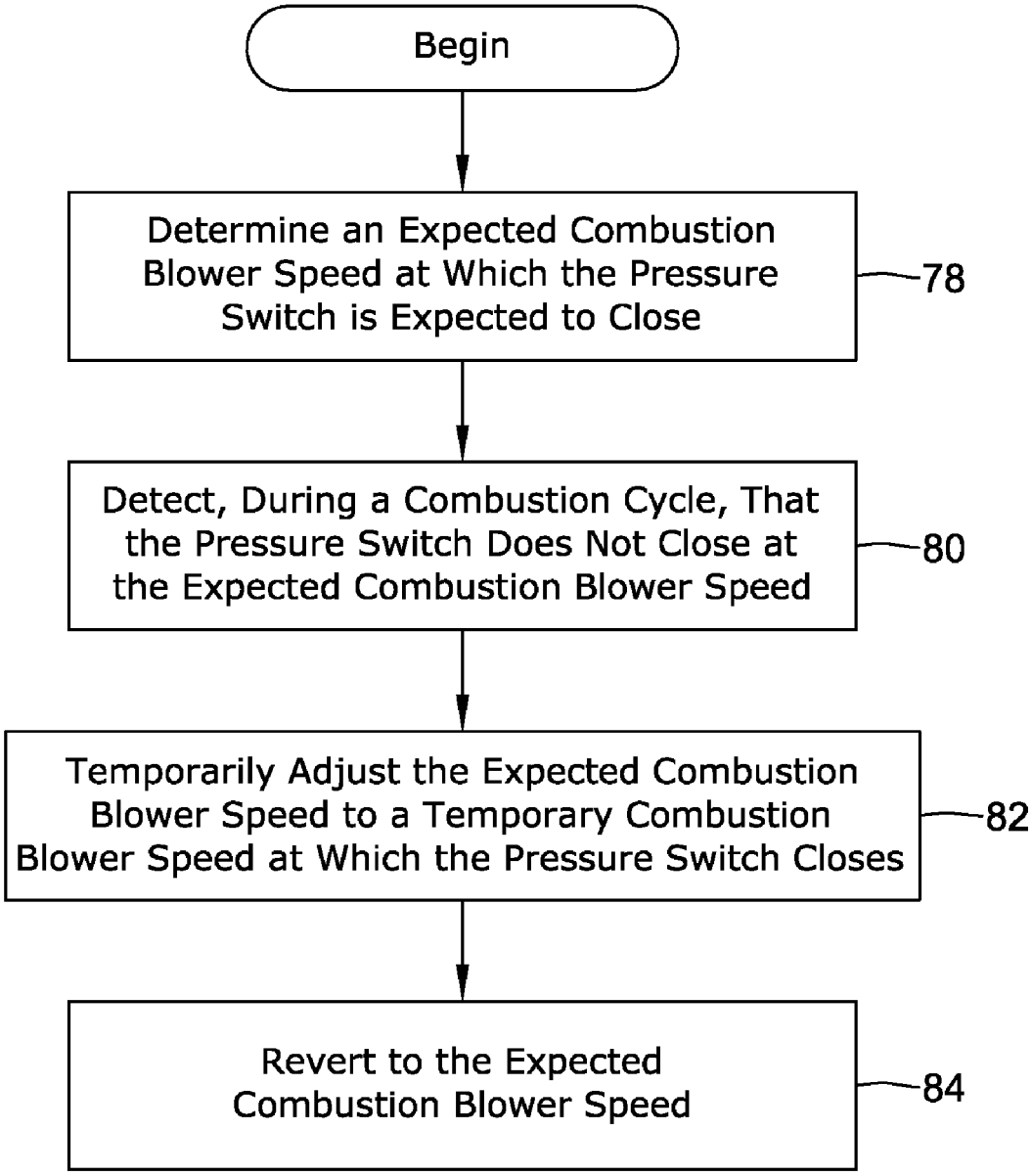

Turning now to FIG. 5, control starts at block 78, where controller 50 (FIG. 1) stores an expected combustion blower speed. This is a blower speed at which a pressure switch, such as first pressure switch 42 (FIG. 1) and/or second pressure switch 44 (FIG. 1) may be expected to change state. The expected combustion blower speed may be determined or calculated using any appropriate method, although in some instances, this may be accomplished using the methods detailed with respect to FIGS. 2 through 4.

Control passes to block 80, where controller 50 (FIG. 1) detects that the pressure switch has not or did not close when the combustion blower speed reached the expected combustion blower speed. This check may be performed prior to a combustion cycle, during a combustion cycle and/or after a combustion cycle, as desired. In some instances, particularly if the pressure switch is a low pressure switch such as low pressure switch 42 (FIG. 1), the pressure switch may be checked at the beginning of a combustion cycle or after the combustion cycle, but this is not required. Alternatively, and particularly if the pressure switch is a high pressure switch such as high pressure switch 44 (FIG. 1), the pressure switch may be checked during a combustion cycle. In some cases, a high pressure switch may be checked while increasing the blower speed to accommodate a higher burner rate. In some cases, a high pressure switch may be checked during a combustion cycle by temporarily increasing the blower speed to a point at or beyond the expected combustion blower speed.

Control then passes to block 82, where controller 50 (FIG. 1) temporarily adjusts the expected combustion blower speed to a temporary blower speed at which the pressure switch will indeed close. In some instances, controller 50 may increment the blower speed by a relatively small amount and then set the temporary combustion blower speed if the pressure switch has indeed closed. The temporary blower speed may be incremented again if the pressure switch remains open and, in some cases, if the temporary combustion blower speed (or the adjustment thereto) has not exceeded a predetermined safety limit. For example, if the temporary blower speed has to be adjusted too far in order for the pressure switch to close, this may indicate an unsafe condition such as a blocked or partially blocked flue 38 (FIG. 1), and controller 50 may then stop furnace operation in order to recalibrate, perform further testing, or solicit maintenance.

At block 84, controller 50 (FIG. 1) may revert back to the expected combustion blower speed some time later. In some instances, controller 50 may revert back to the expected combustion speed at the end of a combustion cycle. In some cases, controller 50 may start a subsequent combustion cycle using the temporary combustion blower speed, and may subsequently decrease the temporary combustion blower speed if conditions have changed and the pressure switch will close at a lower blower speed.

Figure 6:
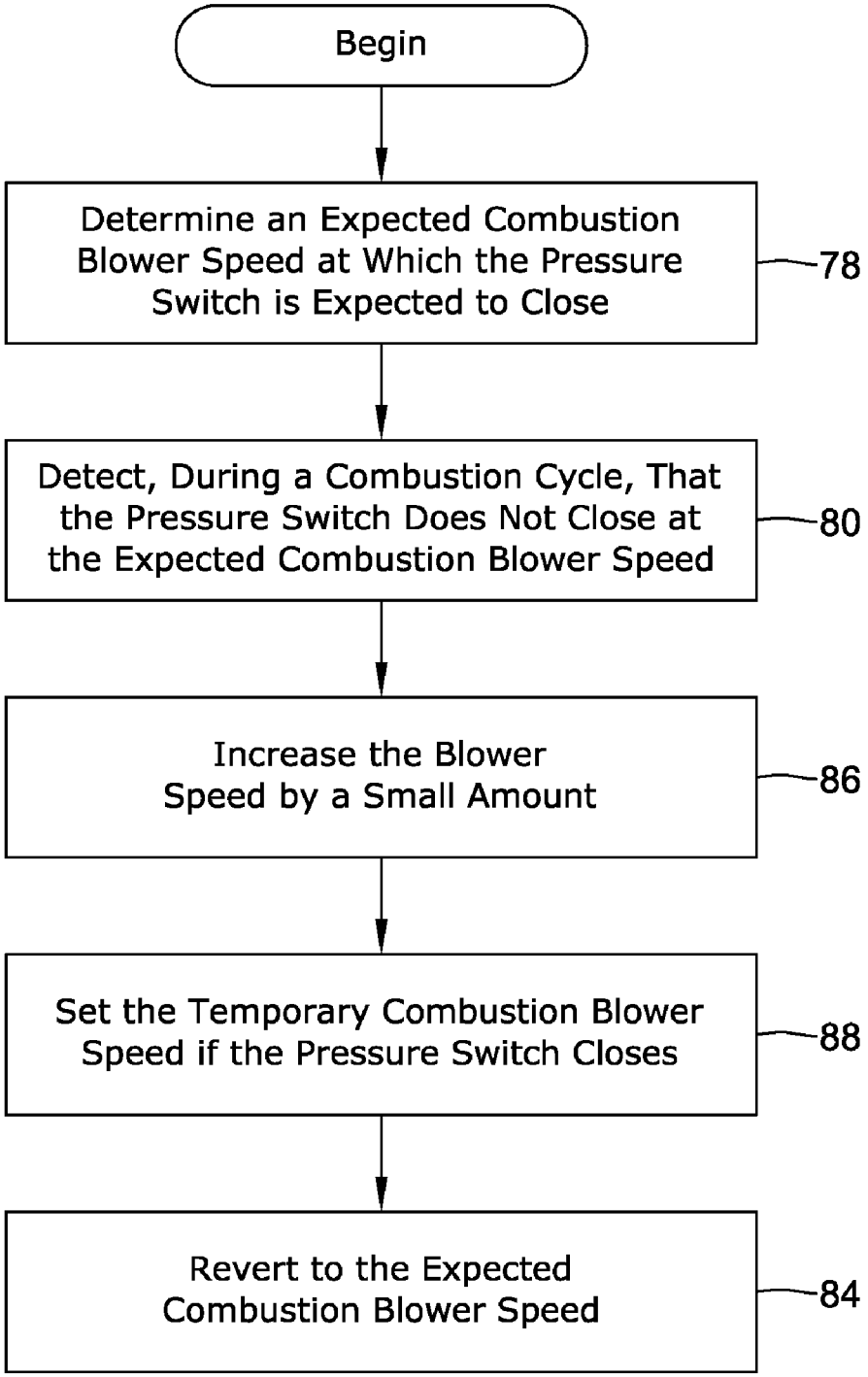

Turning now to FIG. 6, control starts at block 78, where controller 50 (FIG. 1) determines an expected combustion blower speed. Like above, this is a blower speed at which the pressure switch, such as first pressure switch 42 (FIG. 1) and/or second pressure switch 44 (FIG. 1) may be expected to close. The expected combustion blower speed may be determined or calculated using any appropriate method, although in some instances, this may be accomplished using the methods outlined with respect to FIGS. 2 through 4.

Control then passes to block 80, where controller 50 (FIG. 1) detects that the pressure switch has not or did not close when the combustion blower speed reached the expected combustion blower speed. This check may be performed prior to a combustion cycle, during a combustion cycle and/or after a combustion cycle.

At block 86, controller 50 (FIG. 1) increases the blower speed by a relatively small amount. This may represent an increase of 10 RPM, 50 RPM, 100 RPM or the like. In some cases, the increase step size may be a function of furnace particulars and may even be field-determined and/or set. Control then passes to block 88, where the temporary combustion blower speed is set if the pressure switch closes.

At block 84, controller 50 (FIG. 1) may revert back to the expected combustion blower speed at some time later. In some instances, controller 50 may revert back to the expected combustion speed at the end of a combustion cycle. In some cases, controller 50 may start a subsequent combustion cycle using the temporary combustion blower speed, and may subsequently decrement the temporary combustion blower speed if conditions have changed and the pressure switch will close at a lower blower speed.

Figure 7:
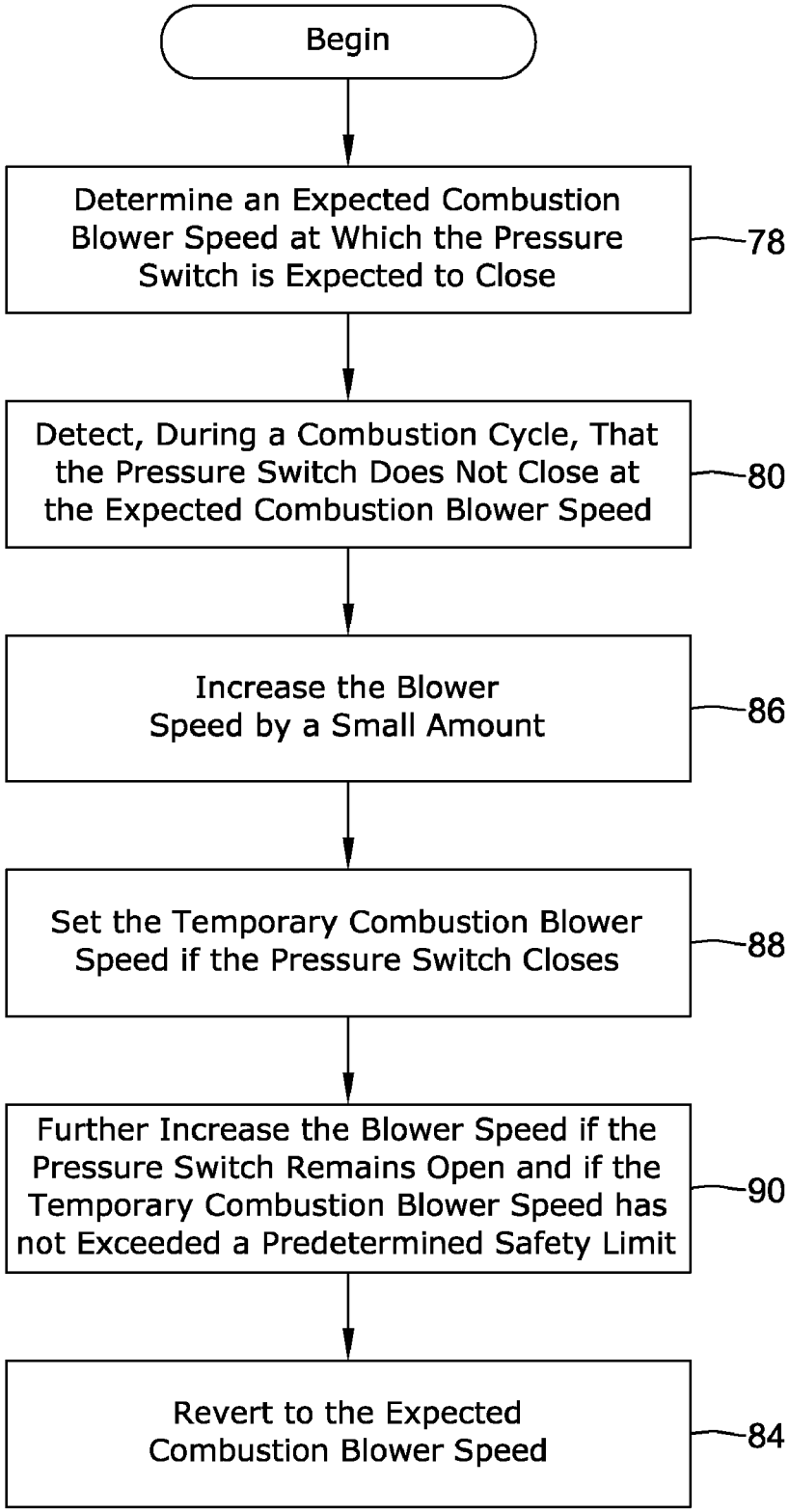

Turning now to FIG. 7, control starts at block 78, where controller 50 (FIG. 1) determines an expected combustion blower speed. Like above, this is a blower speed at which the pressure switch, such as first pressure switch 42 (FIG. 1) and/or second pressure switch 44 (FIG. 1) may be expected to close. The expected combustion blower speed may be determined or calculated using any appropriate method, although in some instances, this may be accomplished using the methods outlined with respect to FIGS. 2 through 4.

Control passes to block 80, where controller 50 (FIG. 1) detects that the pressure switch has not or did not close when the combustion blower speed reached the expected combustion blower speed. This check may be performed prior to a combustion cycle, during a combustion cycle and/or after a combustion cycle.

At block 86, controller 50 (FIG. 1) increases the blower speed by a relatively small amount. This may represent an increase of 10 RPM, 50 RPM, 100 RPM or the like. In some cases, the increase step size may be a function of furnace particulars and may even be field-determined and/or set. Control passes to block 88, where the temporary combustion blower speed is set if the pressure switch closes. At block 90, the blower speed is further increased if the pressure switch has not closed and if the temporary combustion blower speed has not exceeded a predetermined safety limit.

At block 84, controller 50 (FIG. 1) may revert back to the expected combustion blower speed at some time later. In some instances, controller 50 may revert back to the expected combustion speed at the end of a combustion cycle. In some cases, controller 50 may start a subsequent combustion cycle using the temporary combustion blower speed, and may subsequently decrement the temporary combustion blower speed if conditions have changed and the pressure switch will close at a lower blower speed.

Figure 8:
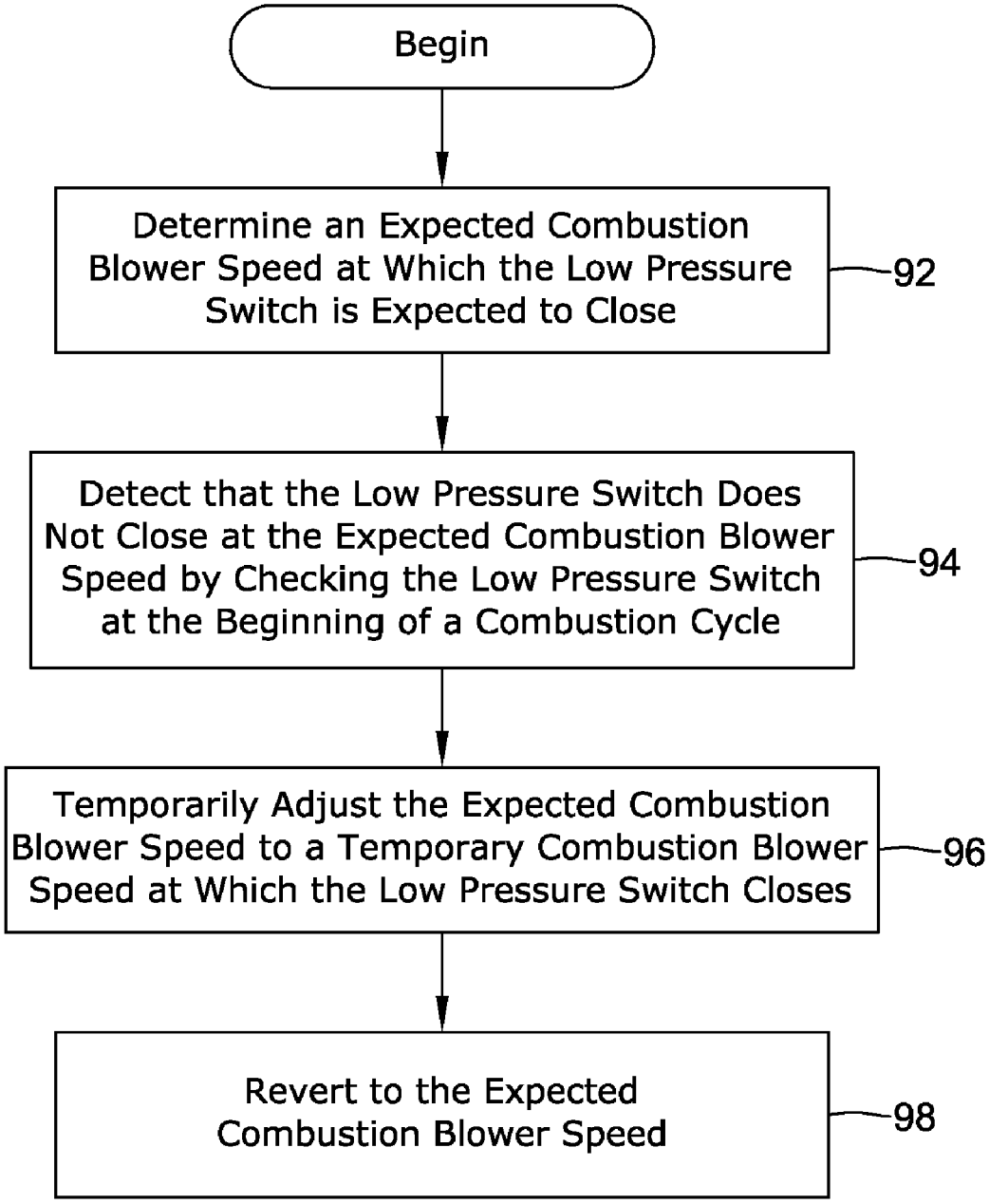

Turning now to FIG. 8, control starts at block 92, where controller 50 (FIG. 1) determines an expected combustion blower speed at which the low pressure switch 42 (FIG. 1) is expected to close. The expected combustion blower speed may be determined or calculated using any appropriate method, although in some instances, this may be accomplished using the methods outlined with respect to FIGS. 2 through 4. Control passes to block 94, where controller 50 (FIG. 1) detects that low pressure switch 42 has not or did not close when the combustion blower speed reached the expected combustion blower speed. This check may be performed by checking low pressure switch 42 prior to, at the beginning of, during, or after a combustion cycle.

At block 96, controller 50 (FIG. 1) temporarily adjusts the expected combustion blower speed to a temporary blower speed at which low pressure switch 42 (FIG. 1) will close. In some instances, controller 50 may increase the blower speed by a relatively small amount and then set the temporary combustion blower speed if low pressure switch 42 has closed. The temporary blower speed may be increased again if low pressure switch 42 remains open and if the temporary combustion blower speed (or the adjustment thereto) has not exceeded a predetermined safety limit. At block 98, controller 50 (FIG. 1) may revert back to the expected combustion blower speed at some time later. In some instances, controller 50 may revert back to the expected combustion speed at the end of a combustion cycle, but this is not required.

Figure 9:
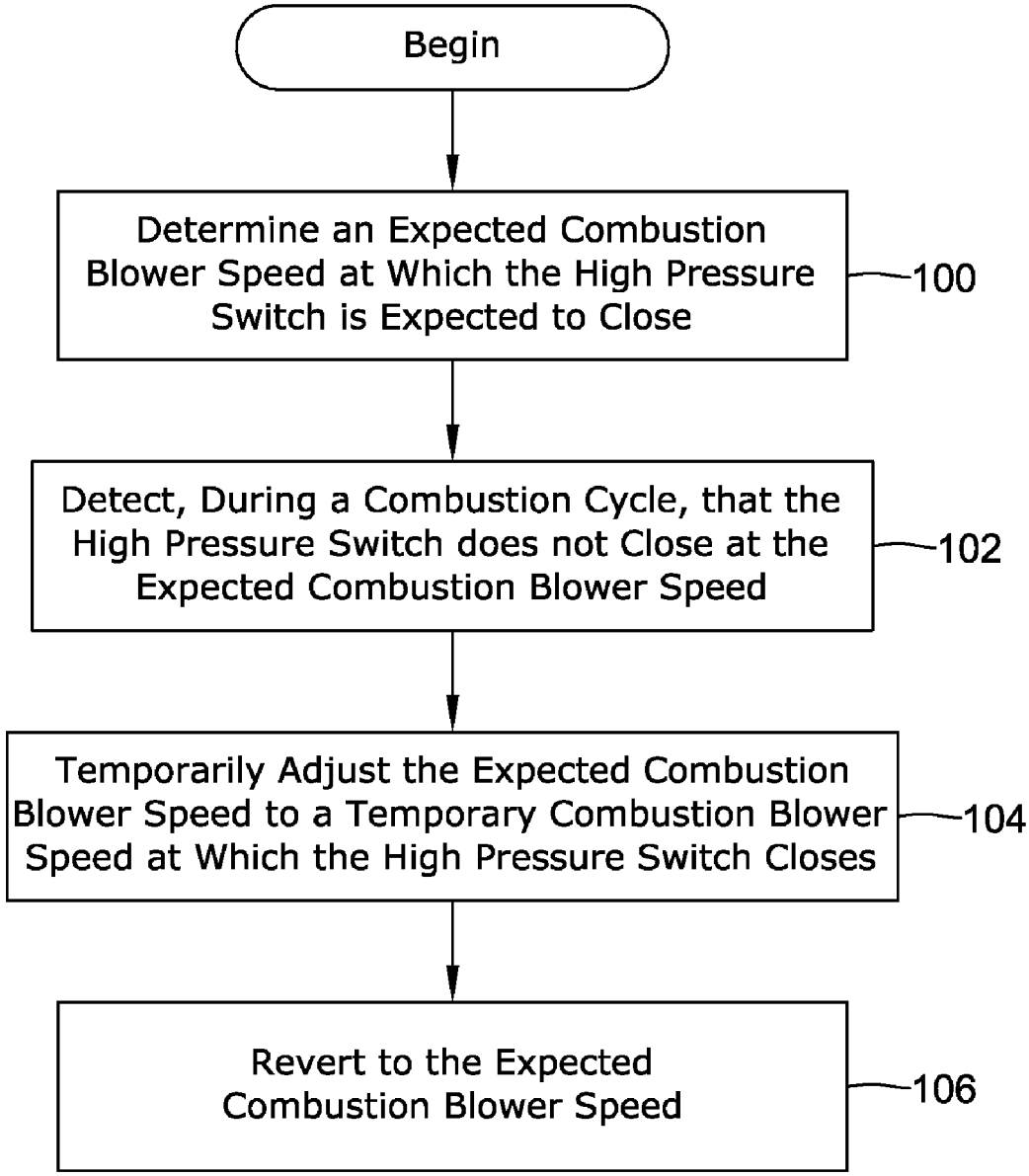

Turning now to FIG. 9, control starts at block 100, where controller 50 (FIG. 1) determines an expected combustion blower speed at which the high pressure switch 44 (FIG. 1) is expected to close. The expected combustion blower speed may be determined or calculated using any appropriate method, although in some instances, this may be accomplished using the methods outlined with respect to FIGS. 2 through 4. Control passes to block 102, where controller 50 (FIG. 1) detects that high pressure switch 44 has not or did not close when the combustion blower speed reached the expected combustion blower speed. This check may be performed by checking high pressure switch 44 prior to, during, or after a combustion cycle.

At block 104, controller 50 (FIG. 1) temporarily adjusts the expected combustion blower speed to a temporary blower speed at which high pressure switch 44 (FIG. 1) will close. In some instances, controller 50 may increase the blower speed by a relatively small amount and then set the temporary combustion blower speed if high pressure switch 44 has closed. The temporary blower speed may be increased again if high pressure switch 44 remains open and if the temporary combustion blower speed (or the adjustment thereto) has not exceeded a predetermined safety limit. At block 106, controller 50 (FIG. 1) may revert back to the expected combustion blower speed at some time later. In some instances, controller 50 may revert back to the expected combustion speed at the end of a combustion cycle or during a subsequent cycle, if desired.

Figure 10:
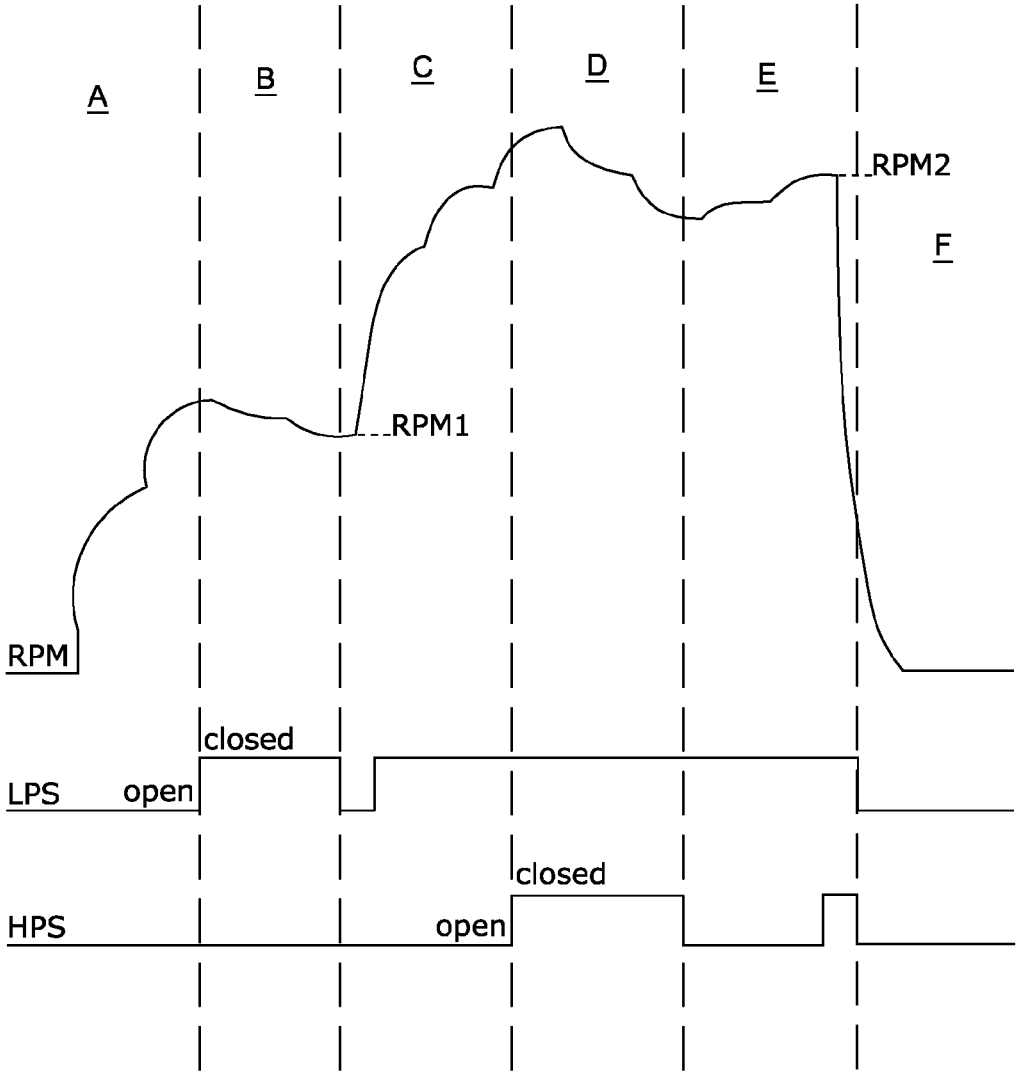
FIGS. 10 and 11 are illustrative but non-limiting graphs showing an example of operation of the furnace of FIG. 1.
Figure 11:
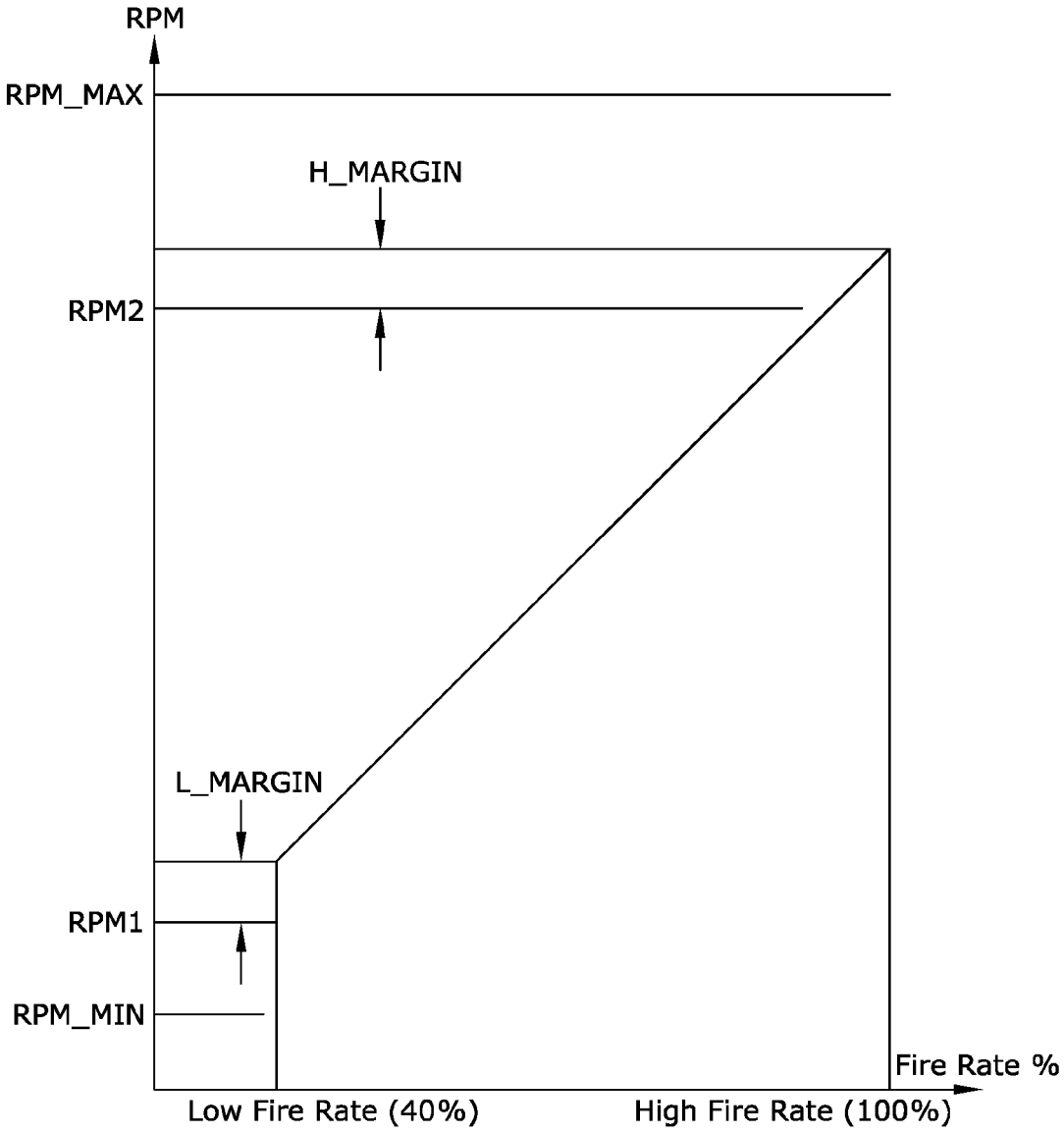

FIGS. 10 and 11 provide an illustrative but non-limiting example of various aspects of the aforementioned methods. In particular, FIG. 10 is a graphical representation of the speed of combustion blower 32 (FIG. 1) relative to the open/closed status of low pressure switch 42 (FIG. 1) and high pressure switch 44 (FIG. 1). For ease of discussion, FIG. 10 is divided into sections. In section A, it can be seen that combustion blower 32 begins at a low or even zero speed, and both pressure switches are open (indicated by a logic low). As the combustion blower speed increases, such as near the transition between section A and section B, the low pressure switch 42 closes. As illustrated by the non-linear RPM curve in section A, the combustion blower speed is first increased by a relatively large amount such as about 1600 RPM, followed by a smaller increment of about 250 RPM. If the low pressure switch 42 had not closed at that point, the combustion blower speed could be further increased.

In section B, low pressure switch 42 (FIG. 1) remains closed. The combustion blower speed is reduced in small steps of about 50 RPM each, until low pressure switch 42 opens again. RPM1, which may in some instances be considered as corresponding to the first operating point discussed previously, may, as illustrated, be set equal to the combustion motor speed at which low pressure switch 42 re-opens. In some cases, RPM1 may be determined to be somewhere between an RPM at which low pressure switch 42 first closes and an RPM at which low pressure switch 42 opens again. Alternatively, RPM1 may be determined to be above the RPM at which low pressure switch 42 first closes by an offset value. Any other suitable method may be used to determine RPM1, as desired. Controller 50 (FIG. 1) may carry out these determinations and/or calculations, as desired. It will be appreciated that due to hysteresis in low pressure switch 42, the blower RPM at which the switch closes and the blower RPM at which the switch opens may not be exactly the same.

In section C, the combustion blower speed is again increased until high pressure switch 44 (FIG. 1) closes. It can be seen that low pressure switch 42 (FIG. 1) quickly closes as the blower speed increases. The combustion blower speed may be increased in any desired amounts. As illustrated, the combustion blower speed is first increased by a large amount, such as about 1200 RPM, followed by two medium sized steps of about 250 RPM. As shown at the transition between section C and section D, high pressure switch 44 closes during the second medium step.

High pressure switch 44 remains closed in section D, having closed at the transition into section D. The combustion blower speed first increases as a result of a motor step taken near the transition between section C and section D. Next, the combustion motor speed is decreased two times by a medium amount such as about 250 RPM each time until high pressure switch 44 (FIG. 1) reopens. It can be seen that high pressure switch 44 reopens at the transition to section E.

In section E, the combustion motor is increased two times using small steps of about 50 RPM each until high pressure switch 44 (FIG. 1) closes again. At this point, controller 50 (FIG. 1) may determine RPM2, which may in some instances be considered as corresponding to the second operating point discussed previously. In some cases, as illustrated, RPM2 may be set equal to the combustion motor speed at the point where high pressure switch 44 re-closes in section E. In some instances, RPM2 may be set equal to some intermediate value between the combustion motor speed at which high pressure switch 44 closed in section D and the combustion motor speed at which high pressure switch 44 closed once again in section E. In some cases, RPM2 may be set equal to the combustion motor speed at which high pressure switch 44 first closes in section D. These are just some examples, and it is contemplated that any suitable method may be used to determine an RPM2 value.

Once RPM2 has been determined, combustion blower motor 32 (FIG. 1) may be shut down. This may be seen in section F, where the combustion blower motor speed drops substantially, and low pressure switch 42 (FIG. 1) and high pressure switch 44 (FIG. 1) reopen. Once RPM1 and RPM2 have been determined, controller 50 (FIG. 1) may interpolate between these two values (or between the two corresponding operation points) to determine a third operating point, a fourth operating point, or as many operating points as may be desired.

FIG. 11 is a graph of combustion motor speed (in RPM) versus burner firing rate. In this particular example, RPM1 may correspond to a low firing rate of 40 percent while RPM2 may correspond to a high firing rate of 100 percent. It can be seen that a first safety margin (labeled as L_margin) has been added to RPM1 and a second safety margin (labeled as H_margin) has been added to RPM2. This helps ensure that the appropriate pressure switches are more likely to close at a particular combustion motor speed corresponding to a desired firing rate, even if there are small and/or transient changes in operating conditions that are not sufficient to warrant larger adjustments (e.g. those adjustments previously discussed with respect to FIGS. 5 through 9).

As illustrated, controller 50 (FIG. 1) has carried out a linear interpolation that permits controller 50 to determine an appropriate combustion blower speed for any desired firing rate. This is merely illustrative, as controller 50 may instead carry out a variety of different interpolations. As discussed above, the particular interpolation carried out may be dependent upon particulars of a furnace and/or installation. In some cases, it is contemplated that an appropriate combustion blower speed may be determined for a desired firing rate using extrapolation, rather than interpolation, if desired.

The invention should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

We claim:

1. A method of operating a modulating forced air furnace comprising a variable speed combustion blower and a controller, the method comprising the steps of:

determining a system time constant;

requesting a change in a combustion blower speed to a new speed;

using the time constant to determine how much time will elapse before the combustion blower will approach the new speed; and changing the speed of the combustion blower accordingly.

2. The method of claim 1, wherein requesting a change in speed of the variable speed combustion blower comprises the controller receiving an increased call for heat from a thermostat.

3. The method of claim 1, wherein changing the speed of the variable speed combustion blower comprises overdriving the combustion blower in order to more quickly reach the new speed, wherein the amount of overdrive is dependent on the determined system time constant.

4. The method of claim 1, wherein determining the system time constant comprises:

adjusting the combustion blower speed;

tracking how much time passes before the combustion blower speed stabilizes; and calculating the system time constant based on how much time passes before the speed of the combustion blower stabilizes.

5. A method of calibrating a variable speed combustion blower disposed within a modulating forced air furnace having a first pressure switch and a second pressure switch, the method comprising the steps of:

determining a system time constant;

changing the speed of the combustion blower;

waiting a period of time that is dependent on the determined system time constant;

after the waiting step, checking to see if the first pressure switch has changed state;

setting a first operating point corresponding to the speed of the combustion blower if the first pressure switch has changed state;

wherein determining the system time constant includes:

adjusting the speed of the combustion blower;

tracking how much time passes before the speed of the combustion blower stabilizes; and calculating the system time constant based on how much time passes before the speed of the combustion blower stabilizes.

6. The method of claim 5, further comprising changing the speed of the combustion blower, waiting a period of time determined by the system time constant, and checking a status of the first pressure switch in an iterative process until the first pressure switch changes state, and then setting the first operating point corresponding to the speed of the combustion blower when the first pressure switch does change state.

7. A method of calibrating a variable speed combustion blower disposed within a modulating forced air furnace having a first pressure switch and a second pressure switch, the method comprising the steps of:

determining a system time constant;

changing the speed of the combustion blower;

waiting a period of time that is dependent on the determined system time constant;

after the waiting step, checking to see if the first pressure switch has changed state; and setting a first operating point corresponding to the speed of the combustion blower if the first pressure switch has changed state;

changing the speed of the combustion blower;

waiting a period of time that is dependent on the determined system time constant;

checking to see if the second pressure switch has changed state;

iterating between changing the speed of the combustion blower, waiting a period of time determined by the system time constant, and checking a status of the second pressure switch until the second pressure switch changes state, and then setting the second operating point corresponding to the speed of the combustion blower when the second pressure switch does change state.

8. The method of claim 7, further comprising a step of calculating a third operating point based upon the first operating point and the second operating point.

9. The method of claim 8, wherein calculating the third operating point comprises interpolating between the first operating point and the second operating point.

10. A method of determining a system time constant for a combustion appliance including a variable speed combustion blower and a controller, the method comprising the steps of:

driving the variable speed combustion blower to a first speed;

determining a first time period for the variable speed combustion blower to approach the first speed;

driving the variable speed combustion blower to a second speed;

determining a second time period for the variable speed combustion blower to approach the second speed; and determining one or more system time constants based on the first speed, the first time period, the second speed and the second time period.

11. The method of claim 10, wherein determining the one or more time constants comprises assuming a first-order system response.

12. The method of claim 10, wherein determining a first time period for the variable speed combustion blower to approach the first speed comprises determining a first time period for the variable speed combustion blower to reach a predetermined percentage of the first speed.

13. The method of claim 10, wherein determining a second time period for the variable speed combustion blower to approach the second speed comprises determining a second time period for the variable speed combustion blower to reach a predetermined percentage of the second speed.

14. The method of claim 10, wherein the second speed is lower than the first speed.

15. The method of claim 10, wherein the second speed is higher than the first speed.

16. The method of claim 10, further comprising determining a plurality of different time constants corresponding to different combustion blower speed ranges.

17. The method of claim 16, further comprising storing the plurality of different time constants for use by the controller.

18. The method of claim 10, further comprising determining a plurality of different time constants corresponding to different amounts of change in combustion blower speed.

19. The method of claim 18, further comprising storing the plurality of different time constants for use by the controller

* * * * *